US006839915B2

(12) United States Patent
Yoshimura

(10) Patent No.: US 6,839,915 B2
(45) Date of Patent: Jan. 11, 2005

(54) JACKET

(75) Inventor: Koji Yoshimura, Osaka (JP)

(73) Assignee: Kabushiki Kaisha Tailor Yoshimura, Osaka (JP)

( * ) Notice: Subject to any disclaimer, the term of this patent is extended or adjusted under 35 U.S.C. 154(b) by 178 days.

(21) Appl. No.: 10/226,042

(22) Filed: Aug. 22, 2002

(65) Prior Publication Data

US 2003/0177567 A1 Sep. 25, 2003

(30) Foreign Application Priority Data

Mar. 25, 2002 (JP) ..... 2002-082556

(51) Int. Cl.[7] ..... A41D 27/20
(52) U.S. Cl. ..... 2/250; 2/247
(58) Field of Search ..... 2/69, 93, 108, 2/247, 248, 249, 250, 251, 252, 253, 254, 49.2; D2/836, 839, 857

(56) References Cited

U.S. PATENT DOCUMENTS

| | | | | | |
|---|---|---|---|---|---|
| 800,790 | A | * | 10/1905 | Boland | 2/94 |
| 911,761 | A | * | 2/1909 | Reep | 2/249 |
| 1,116,128 | A | * | 11/1914 | Rudloff | 2/253 |
| 1,485,567 | A | * | 3/1924 | Myer | 2/253 |
| 1,639,830 | A | * | 8/1927 | Wood | 2/247 |
| 2,211,420 | A | * | 8/1940 | Hausdorff | 2/247 |
| 2,495,582 | A | * | 1/1950 | Henderson | 2/94 |
| 2,859,449 | A | * | 11/1958 | Ellison | 2/253 |
| 3,077,604 | A | * | 2/1963 | Colangelo | 2/93 |
| 3,246,343 | A | * | 4/1966 | Gilligan | 2/250 |
| 3,320,620 | A | * | 5/1967 | Weidler et al. | 2/250 |
| 4,123,804 | A | * | 11/1978 | Michael et al. | 2/247 |
| 4,553,269 | A | * | 11/1985 | Nowak | 2/254 |
| 6,216,280 | B1 | * | 4/2001 | Rabe | 2/247 |
| 6,339,846 | B2 | * | 1/2002 | Uchida | 2/247 |

FOREIGN PATENT DOCUMENTS

JP 10195705 A * 7/1998 ..... A41D/27/20

* cited by examiner

*Primary Examiner*—John J. Calvert
*Assistant Examiner*—Alissa L. Hoey
(74) *Attorney, Agent, or Firm*—Koda & Androlia

(57) ABSTRACT

A passage extending from the upper pocket to the lower outlet being formed. The lower end of the passage has a receptacle positioned immediately above the outlet. At a location upward of the receptacle, another outlet that opens to one side of the passage is formed. The outlet and the lower outlet are connected to each other via an outlet passage. When a cell phone is dropped in from the upper pocket, it glides down inside the passage and is received by the receptacle established at the lower end. When the wearer of the jacket inserts fingers through the lower outlet and pushes up the receptacle, he can easily push out the cell phone held inside through the outlet, which opens to one side of the passage. The cell phone can be taken out from the lower outlet which is connected to the outlet via an outlet passage.

2 Claims, 8 Drawing Sheets

JACKET

BACKGROUND OF THE INVENTION

1. Field of the Invention

The present invention relates to a jacket with which small items such as a cell phone, eyeglasses, etc., can be put into a pocket in the upper part of the jacket and taken out from an outlet in the lower part of the jacket.

2. Prior Art

Small items such as a cell phone, eyeglasses, etc., are usually carried in a chest pocket, a side pocket or an interior pocket of a jacket. In accordance with the widespread use of cell phones, jackets incorporating a cell-phone pocket on the outside or inside of the jacket are sold.

Carrying a cell phone, eyeglasses and other small items in a chest pocket, a side pocket or an interior pocket of a jacket causes the pocket to bulge, resulting in a rather inelegant appearance. In particular, when such an item is put into a chest pocket down to the ordinary depth, the item may press against the wearer's chest, causing an uncomfortable sensation. Moreover, when such an item is put into a chest pocket or an interior pocket, the item can move in any direction at random, for example, it can slant or turn sideways. In particular, the interior pocket is usually designed to have a depth that is suitable for carrying a wallet, so in order to take out a small item, the wearer needs to insert their hand deep inside the pocket. It is awkward either to put such an item into or to take it out of such a pocket. If the item is a cell phone, every time it rings, the wearer needs to insert their hand deep inside the pocket to search for it, and put it back after the call is completed. This can be quite troublesome, especially when it has to be done many times.

If the wearer could put the item into a pocket in the upper part of the jacket and take it out easily from an outlet in the lower part of the jacket, considerable inconvenience could be eliminated. It would be ideal if an item put into the upper pocket could be held above the lower outlet, and preferably just above the outlet, so that the pocket will not bulge or become bulky.

The inventor developed a jacket that meets such a demand and filed an application for patent on Jan. 21, 2002 (Japanese Patent Application No. 2002-011589). In this prior invention, a passage is provided that connects a pocket on the upper part of the jacket with an outlet on the lower part of the jacket, and above the outlet, preferably immediately above the outlet, a means that opens and closes the passage is established.

This prior invention by the same inventor and applicant can satisfactorily achieve the objective explained above. The inventor has further contrived to develop a convenient and cost-advantageous jacket having a device that firmly receives an item dropped in through the upper pocket and that does not require the means to open or close the passage that leads to the lower outlet, and has successfully completed the present invention.

SUMMARY OF THE INVENTION

In the present invention, at the lower end of a passage 3, which extends from the upper pocket 1 to the lower outlet 2, a receptacle 4 is provided immediately above the outlet 2. At a location upward of the receptacle 4, another outlet 5 is provided so as to open to one side of the passage 3. This outlet 5 and the aforementioned outlet 2 are connected via an outlet passage 6.

When an item T is dropped in through the pocket 1 in the upper part of the jacket, it glides down inside the passage 3 and is firmly received by the receptacle 4 established at the lower end. This eliminates the possibility of losing the item T dropped in through the pocket 1. Moreover, the pocket does not bulge or become bulky. The receptacle 4 can be positioned at a location where the corresponding part of the wearer's body is comparatively less protruding. This makes it possible to minimize any bulging and bulkiness of the pocket. An extremely simple construction can be used as the means for receiving the item dropped in through the pocket, making the present invention highly cost effective.

When the wearer of the jacket inserts their fingers through the lower outlet 2 and pushes up the receptacle 4, they can easily push out the item T held inside through the outlet 5, which opens to one side of the passage 3, into the outlet passage 6, which connects the outlet 5 with the lower outlet 2, and then take the item out from the lower outlet 2.

In other words, the present invention makes it possible for the wearer to put a small item into the upper pocket 1 and easily take it out from the lower outlet 2, freeing them from the awkwardness involved in putting a small item into and taking it out of the same pocket.

Ideally the upper pocket 1 is a chest pocket A, and the lower outlet 2 is connected to a side pocket B. In this configuration, because the chest pocket A is on the outside and in the upper part of the jacket, it is very easy for the wearer to put the item T into the chest pocket A. And because the wearer can insert their hand into the side pocket B from outside of the jacket and extend their fingers to the lower outlet 2, they can easily take out the item T without taking off or unbuttoning the jacket.

DETAILED DESCRIPTION OF THE INVENTION

Preferred embodiments of the present invention will now be described by reference to the accompanying drawings.

Figure 1:
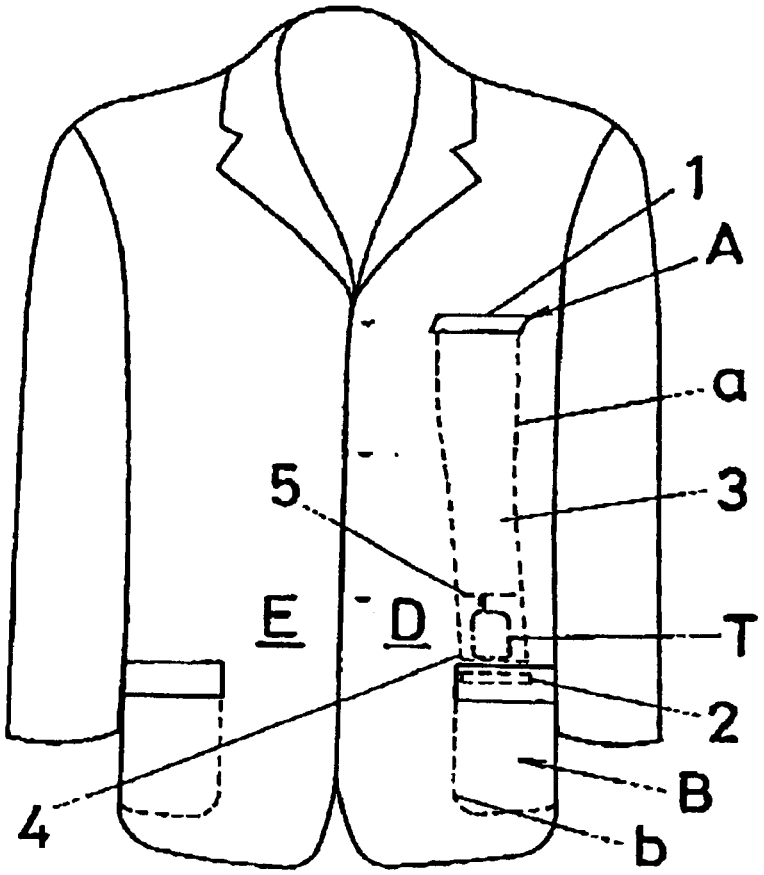
FIG. 1 shows a front view of an example of the jacket according to the present invention, in which the upper pocket is a chest pocket, and the lower outlet is connected to a side pocket. In this example, the chest pocket, i.e., the upper pocket, the receptacle, the outlet, the outlet passage and the lower outlet are connected to each other.

FIG. 1 shows an example of a jacket in which the upper pocket 1 is a chest pocket A, the lower outlet 2 is connected to a side pocket B, and a passage 3 is established in such a way that it runs from the upper pocket 1, i.e., chest pocket A, to the lower outlet 2.

Figure 2:
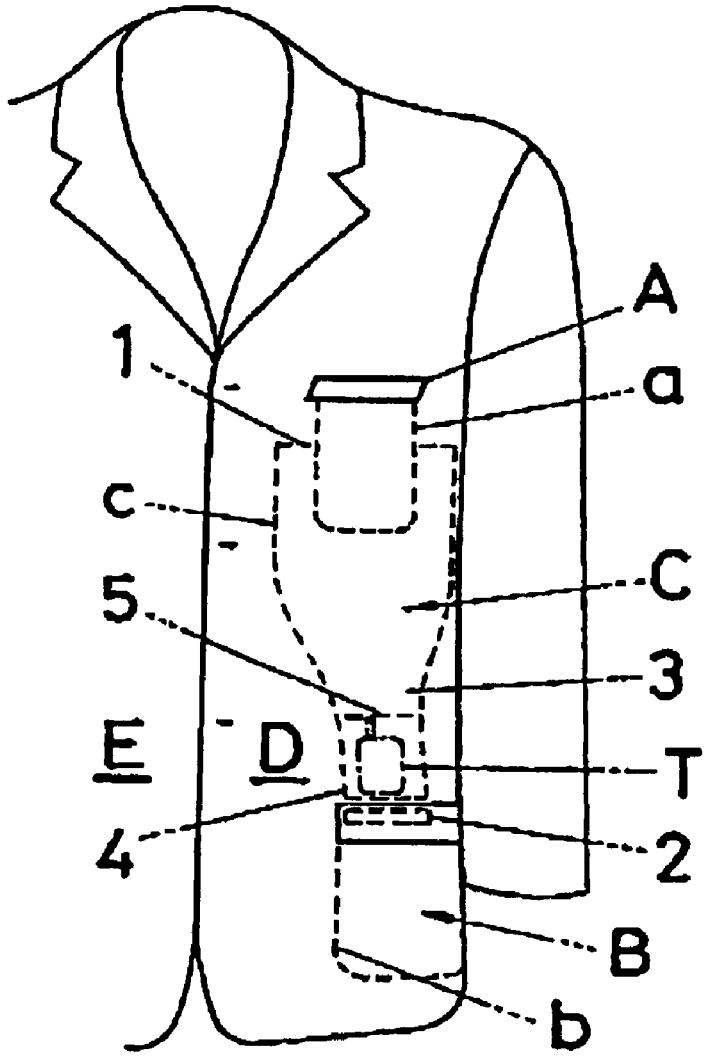
FIG. 2 shows a front view of another example of the jacket according to the present invention, in which the upper pocket is an interior pocket, and the lower outlet is connected to a side pocket. In this example, the interior pocket, i.e., the upper pocket, the receptacle, the outlet, the outlet passage and the lower outlet are connected to each other.

FIG. 2 shows an example of a jacket in which the upper pocket 1 is an interior pocket C, the lower outlet 2 is connected to a side pocket B, and a passage 3 is established in such a way that it runs from the upper pocket, i.e., interior pocket C, to the lower outlet 2.

Figure 3:
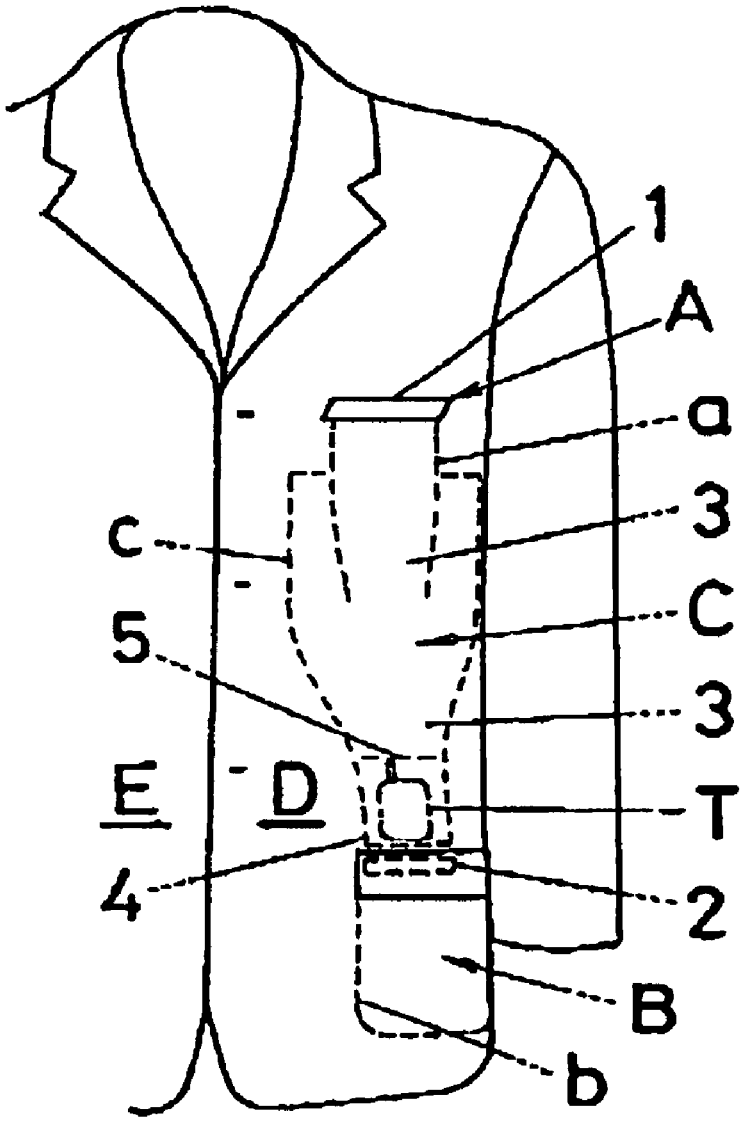
FIG. 3 is a front view of yet another example of the jacket according to the present invention, in which the upper pocket is a chest pocket, and the lower outlet is connected to a side pocket. In this example, the exterior (chest) pocket, i.e., the upper pocket, an interior pocket, the receptacle, the outlet, the outlet passage and the lower outlet are connected to each other.

FIG. 3 shows an example of a jacket in which the upper pocket 1 is a chest pocket A, the lower outlet 2 is connected to a side pocket B, and a passage 3 is established in such a way that it runs from the upper pocket 1, i.e., the chest pocket A, through an interior pocket C to the lower outlet 2.

The passage 3 can be formed from a piece of tubular fabric and is equipped with a receptacle 4 at its lower end. In the jacket shown in FIG. 1, the upper edge of a piece of tubular fabric 3*a* having a bottom, which functions as the receptacle 4, is sewn into an opening formed by cutting open a portion of the bottom of the pocket bag a of the chest pocket A. A portion of the fabric 3*a* on the inner side of the jacket (on the left-hand side in FIG. 4) is cut off above the receptacle 4 so as to form another outlet 5.

Adjacent to the outlet 5 (on the left-hand side in FIG. 4), an outlet passage 6 is formed. In the example shown in FIG. 4, a piece of fabric 6*a* is provided so as to cover the outlet 5. The upper end of the fabric 6*a* is sewn into the fabric on the inner side (the left-hand side of FIG. 4) of the tubular fabric 3*a*, which forms the passage 3, while the lower end of the fabric 6*a* is sewn into the upper end of the fabric on the inner side (left-hand side in FIG. 4) of the pocket bag b of the side pocket B. Another piece of fabric 2*a* is sewn into the front side of the tubular fabric 3*a* (the fabric on the right-hand side in FIG. 4). The lower end of the fabric 2*a* is sewn into the besom F of the side pocket B, in which a portion of the upper end of the pocket bag b is cut open so as to function as the lower outlet 2.

In this way, the outlet 5 can be connected to the lower outlet 2 via the outlet passage 6.

In the jacket shown in FIG. 2, the upper end of a piece of tubular fabric 3*b* having a bottom, which functions as the receptacle 4, is sewn into an opening formed by cutting open a portion of the bottom of the pocket c of the interior pocket C. A portion of the fabric 3*b* on the inner side of the jacket (on the left-hand side in FIG. 5) is cut off above the receptacle 4 so as to form yet another outlet 5.

Adjacent to the outlet 5 (on the left-hand side in FIG. 5), an outlet passage 6 is formed. In the example shown in FIG. 5, a piece of fabric 6*a* is provided so as to cover the outlet 5. The upper end of the fabric 6*a* is sewn into the fabric on the inner side (the left-hand side in FIG. 5) of the pocket c of the interior pocket C, while the lower end of the fabric 6*a* is sewn into the upper end of the fabric on the inner side (the left-hand side in FIG. 5) of the pocket b of the pocket B. Another piece of fabric 2*a* is sewn into the part of the fabric 3*b* on the front side of the pocket c of the interior pocket C (the fabric on the right-hand side in FIG. 5). The lower end of the fabric 2*a* is sewn into the besom F of the side pocket B, in which a portion of the upper end of the pocket bag b is cut open so as to function as the lower outlet 2.

In this way, the outlet 5 can be connected to the lower outlet 2 via the outlet passage 6.

In the example shown in FIG. 2, the interior pocket C, the passage 3, the outlet passage 6 and the outlet 2, which are connected to each other, are all on the outer front side D of the jacket. It is also possible to have the corresponding components on the inner front side E of the jacket can be connected to each other.

In the jacket shown in FIG. 3, the upper end of a piece of tubular fabric 3*c* is sewn into an opening made by cutting open a portion of the bottom of the pocket bag a of the chest pocket A, and the lower end of the tubular fabric 3*c* is sewn into an opening made by cutting open the side of the pocket c of the interior pocket C. In addition, the upper end of another piece of tubular fabric 3*d* having a bottom, which functions as the receptacle 4, is sewn into an opening formed by cutting open a portion of the bottom of the pocket c of the interior pocket C. A portion of the fabric 3*d* on the inner side of the jacket (on the left-hand side in FIG. 6) is cut off above the receptacle 4 so as to form another outlet 5.

Adjacent to the outlet 5 (on the left-hand side in FIG. 6), an outlet passage 6 is formed. In the example shown in FIG. 6, a piece of fabric 6*a* is provided so as to cover the outlet 5. The upper end of the fabric 6*a* is sewn into the fabric on the inner side (the left-hand side in FIG. 6) of the pocket c of the interior pocket C, while the lower end of the fabric 6*a* is sewn into the upper end of the fabric on the inner side (the left-hand side in FIG. 6) of the pocket b of the side pocket B. Another piece of fabric 2*a* is sewn into the fabric on the outer side (the right-hand side in FIG. 6) of the pocket bag c of the interior pocket C. The lower end of the fabric 2*a* is sewn into the besom F of the side pocket B, in which a portion of the upper end of the pocket bag b is cut open so as to function as the lower outlet 2.

In this way, the outlet 5 can be connected to the lower outlet 2 via the outlet passage 6.

The passage 3, the outlet 5 and the outlet passage 6 preferably have widths and depths that are large enough to allow an item T dropped in through the pocket A to pass through but not so large as to allow the item to undergo random movement, e.g., slanting and turning sideways. It is advantageous to form the passage 3 and the outlet passage 6 using a stretchable and glidable fabric, e.g., nylon or polyester, so that the item T slides down smoothly.

Figure 7:
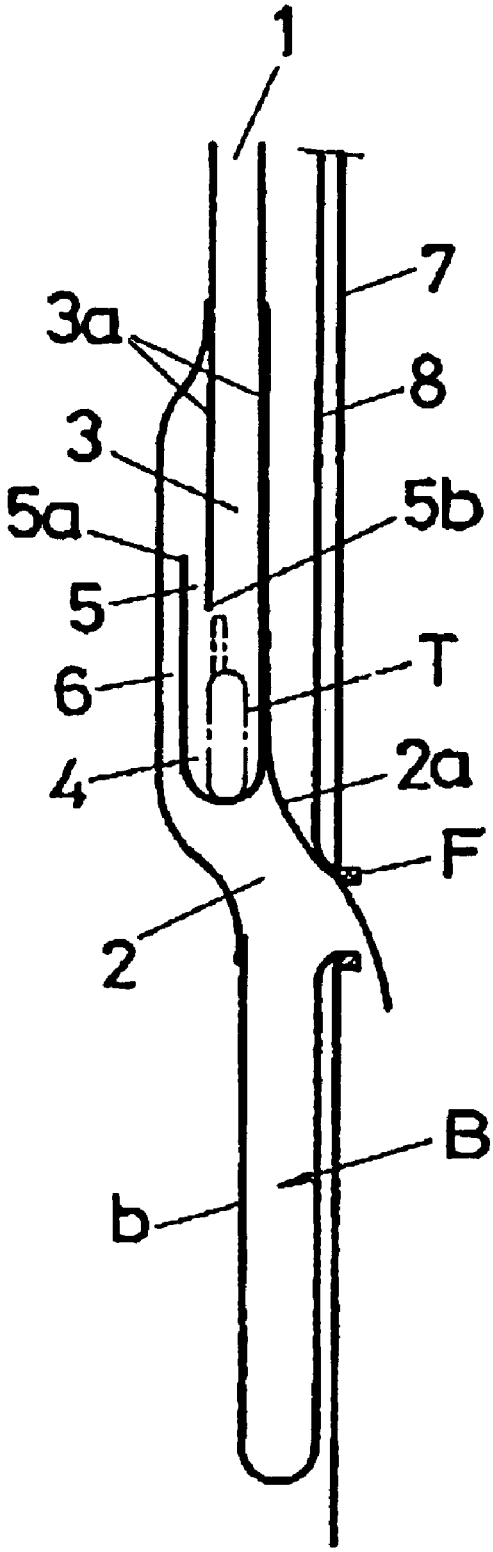
FIG. 7 shows an enlarged cross sectional view depicting the basic concept of the present invention.

When an item T is dropped in through the upper pocket 1, it glides down inside passage 3 and, as shown in a magnified view in FIG. 7, is firmly received by the receptacle 4 established at the lower end. This eliminates the possibility of losing the item T dropped in through the upper pocket 1. Moreover, the pocket does not bulge or become bulky.

When the wearer of the jacket inserts their fingers through the lower outlet 2 and pushes up the receptacle 4, they can easily push out item T held inside through the outlet 5, which opens to one side of the passage 3, into the outlet passage 6, which connects the outlet 5 to the lower outlet 2, and thereby take it out from the lower outlet 2.

In this way, the wearer of the jacket can put a small item into the upper pocket 1 and easily take it out from the lower outlet 2, freeing them from the awkwardness involved in putting a small item into and taking it out of the same pocket.

In the above arrangement, as shown in FIG. 7, the upper end 5*a* of the outlet 5 is positioned higher than the lower end 5*b* so as to prevent the outlet 5 from opening when the item T is held at the receptacle 4. In this way, the item T can be held more firmly by the receptacle 4.

There are several possibilities with regard to the position of the outlet 5 and the relative positions of the upper end 5*a* and the lower end 5*b* as well as with regard to the material and shape of the sack that forms the receptacle 4. The basic concept of the present invention is that the receptacle 4 receives the item T that is dropped in through the upper pocket 1, and that the item T travels through the outlet 5 and the outlet passage 6 so that it can be taken out from the lower outlet 2.

In FIGS. 4 to 8(*b*), the reference numeral 7 is a front fabric and the reference numeral 8 is a canvas. In FIGS. 4 to 6 and 8(*a*) and 8(*b*), the reference numeral 9 is a lining.

Figure 4:
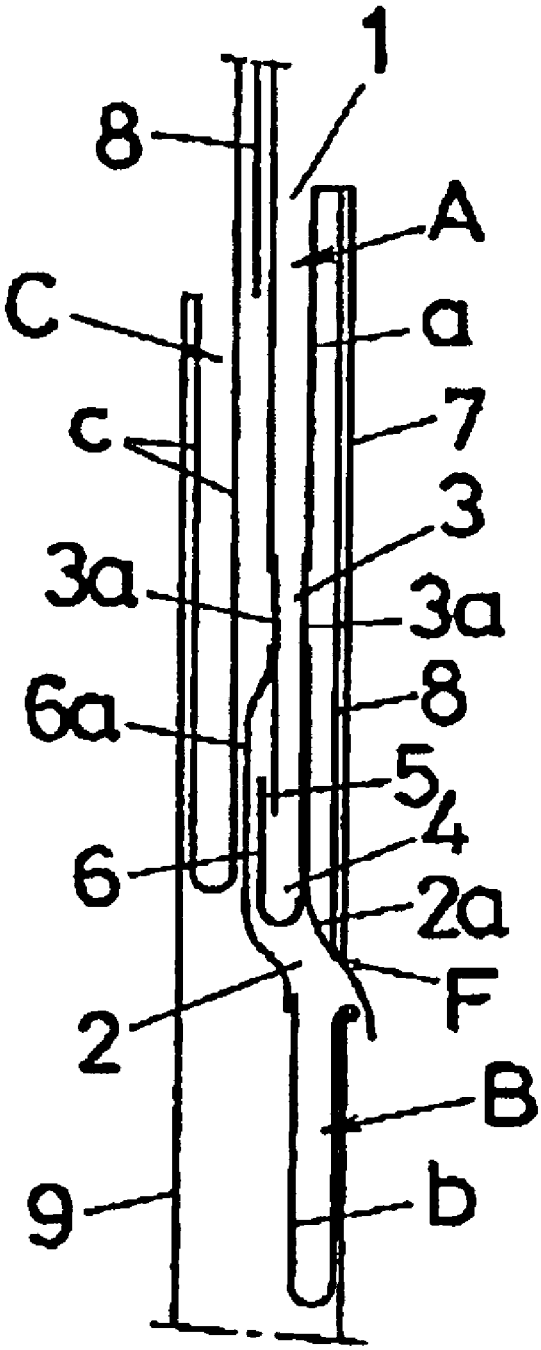
FIG. 4 shows an enlarged cross sectional view of the core part of the jacket shown in FIG. 1.

In the examples shown in FIGS. 1 and 4, the item T is dropped in through the chest pocket A, which is the upper pocket 1. The item T glides down inside the passage 3 and is firmly received by the receptacle 4 established at the lower end.

When the wearer of the jacket inserts their fingers through the lower outlet 2 and pushes up the receptacle 4, they can easily push out the item T held inside through the outlet 5, which opens from one side of the passage 3, into the outlet passage 6, which connects the outlet 5 to the lower outlet 2, and then take it out from the lower outlet 2.

In this example, the item can be dropped in and taken out from the outside (i.e., the front) of the jacket, which is quite convenient.

Figure 5:
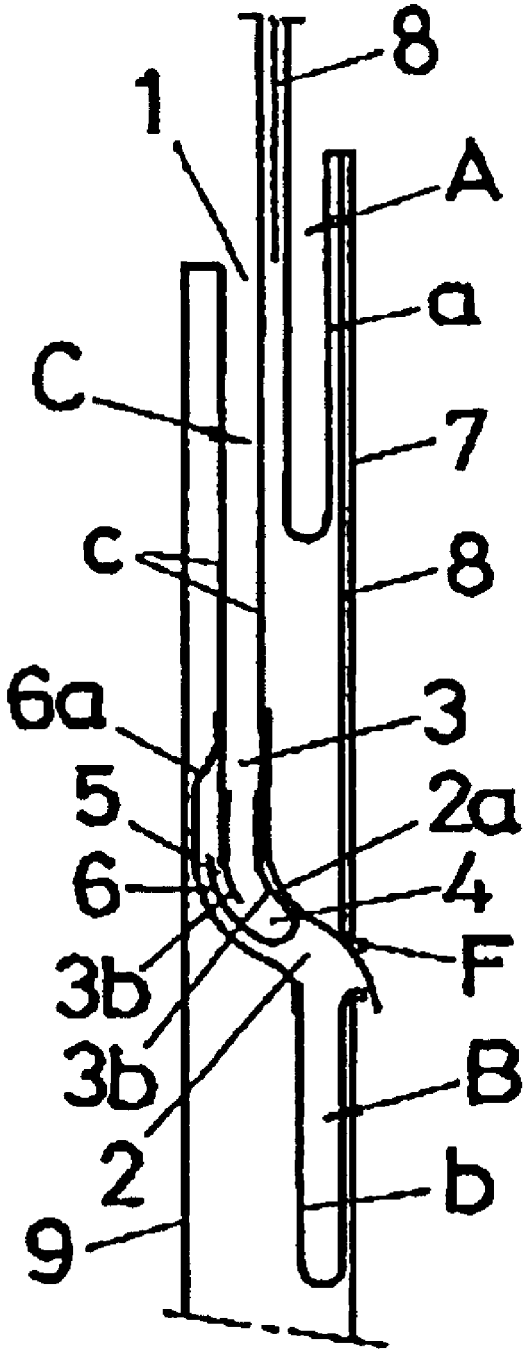
FIG. 5 shows an enlarged cross sectional view of the core part of the jacket shown in FIG. 2.

In the example shown in FIGS. 2 and 5, the item T is dropped in through the interior pocket C, which is the upper pocket 1. The item T travels through the opening formed on the bottom of the pocket bag c of the interior pocket C and is firmly received by the receptacle 4 positioned immediately below the opening.

When the wearer of the jacket inserts their fingers through the lower outlet 2 and pushes up the receptacle 4, they can easily push out the item T held inside through the outlet 5, which opens from one side of the passage 3, into the outlet passage 6, which connects the outlet 5 to the lower outlet 2, and then take it out from the lower outlet 2.

Figure 6:
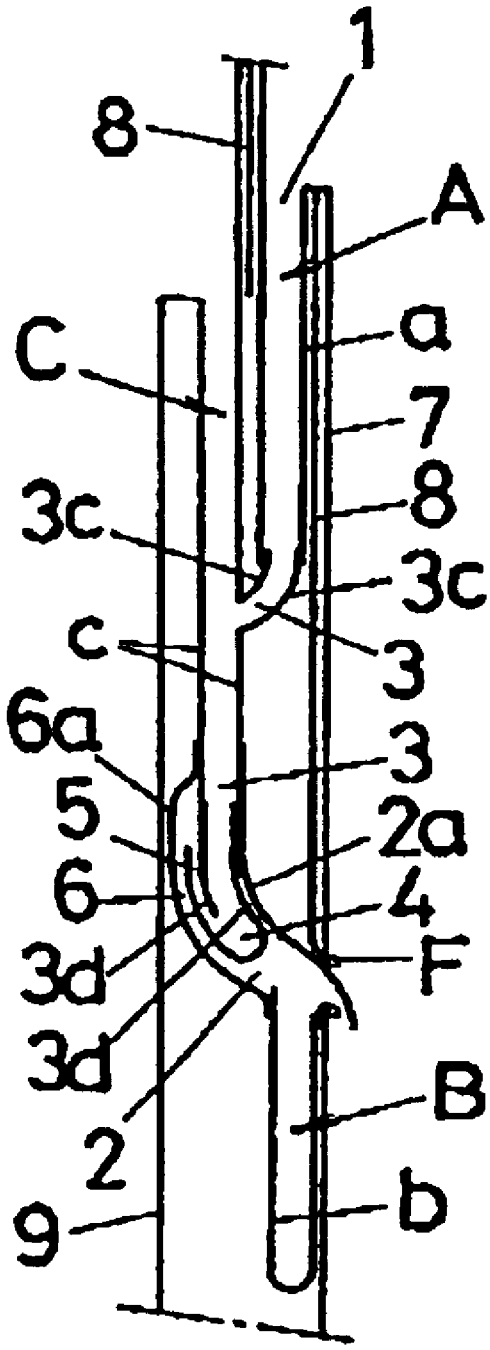
FIG. 6 shows an enlarged cross sectional view of the core part of the jacket shown in FIG. 3.

In the example shown in FIGS. 3 and 6, the item T is dropped in through the chest pocket A, which is the upper pocket 1. The item T glides down through the opening formed by cutting open a portion of the bottom of the pocket bag a of the chest pocket A, enters the pocket bag c of the side pocket C through the opening formed by cutting open a side of the pocket c of the interior pocket C, and continues to glide down through the opening formed in the bottom of the pocket bag c until it reaches and stays at the receptacle 4 positioned immediately below said opening.

When the wearer of the jacket inserts their fingers through the lower outlet 2 and pushes up the receptacle 4, they can easily push out item T held inside through the outlet 5, which opens to one side of the passage 3, into the outlet passage 6, which connects the outlet 5 to the lower outlet 2, and then take it out from the lower outlet 2.

In all of the examples shown above, the wearer of the jacket only needs to drop in item T through the upper pocket 1, which may be a chest pocket A or an interior pocket C, to have it travel inside the jacket to the lower outlet 2. On the way to the lower outlet 2, the item T is received by the receptacle 4 and remains there. Then the wearer of the jacket can insert their hand into the side pocket B and push up the receptacle 4 to easily force out the item T held there to the outlet passage 6 through the outlet 5 formed on one side of the passage 3. The wearer of the jacket can easily take out the item T from the lower outlet 2, which is connected to the outlet 5 through the outlet passage 6.

Figure 8A:
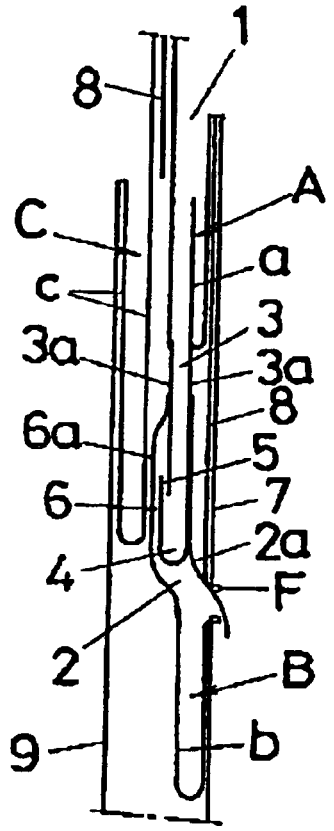
FIGS. 8(*a*) and 8(*b*) show enlarged cross sectional views of examples with an improved chest pocket.
Figure 8B:
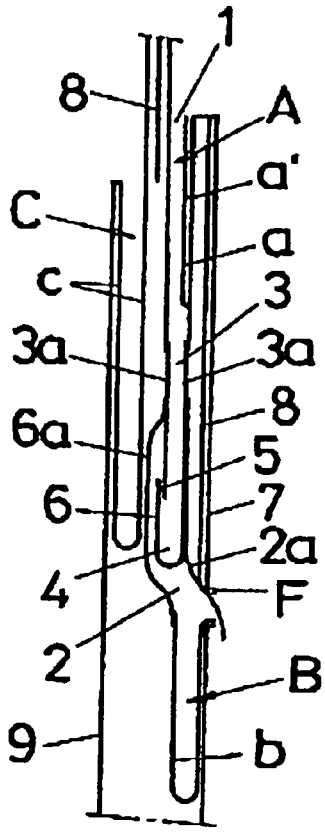

If, as described above, an opening is formed in a portion of the pocket bag a of the chest pocket A, it is difficult to use the pocket A as an ordinary chest pocket. The example shown in FIG. 8(*a*) solves this problem by separating the chest pocket A, which is an ordinary chest pocket, from the passage 3. Alternatively, as shown in FIG. 8(*b*), a handkerchief holder can be provided within the chest pocket A, which itself is connected to the passage 3 via an opening. In this example, the chest pocket A can at least hold a handkerchief.

The present invention allows the wearer of the jacket to put a small item into the upper pocket and take it out easily from the lower outlet 2, freeing them from the awkwardness involved in putting a small item into and taking it out of the same pocket. The invention can firmly hold the item dropped into the pocket, eliminating the possibility of the item being lost. The invention also has the advantage of minimizing any bulging or bulkiness of the pocket. An extremely simple construction can be used as the means for receiving the item dropped in through the pocket, making the present invention extremely cost effective.

The present invention has the following advantages. Because it allows the wearer of the jacket to put a small item into the chest pocket, which is on the outside and in the upper part of the jacket, it is extremely easy to put the item into the pocket. And because the wearer can insert their hand into the side pocket from outside of the jacket and extend their fingers to the lower outlet 2, they can easily take out the item dropped in without taking off or unbuttoning the jacket.

What is claimed is:

1. A jacket comprising a pocket (1) in the upper part of the jacket, an outlet (2) in the lower part of the jacket, and a passage (3) extending from the upper pocket (1) to the lower outlet (2), in which a receptacle (4) is formed at the lower end of the passage (3) and immediately above the outlet (2), another outlet (5) opening on one side of the passage (3) is formed above the receptacle (4), and the outlet (5) in the lower part of the jacket and the outlet (2) opening to one side of the passage (3) are connected to each other via an outlet passage (6).

2. A jacket described in claim 1 in which the pocket (1) is a chest pocket (A), and the outlet (2) opening to one side of the passage (3) is connected to a side pocket (B).

* * * * *